US011668325B2

(12) United States Patent
Nanjappa et al.

(10) Patent No.: US 11,668,325 B2
(45) Date of Patent: Jun. 6, 2023

(54) BRACKET ASSEMBLY FOR AN HVAC SYSTEM

(71) Applicant: Johnson Controls Technology Company, Auburn Hills, MI (US)

(72) Inventors: Vinay Nanjappa, Bangalore (IN); Nitin C. Dabade, Sangli (IN); Tejas S. Pujare, Thane (IN); Snehal S. Bhandare, Phaltan (IN); Vishal S. Jagtap, Dombivli (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 763 days.

(21) Appl. No.: 16/596,485

(22) Filed: Oct. 8, 2019

(65) Prior Publication Data

US 2021/0071686 A1 Mar. 11, 2021

Related U.S. Application Data

(60) Provisional application No. 62/898,944, filed on Sep. 11, 2019.

(51) Int. Cl.
*F04D 29/64* (2006.01)
*F24F 1/38* (2011.01)
(Continued)

(52) U.S. Cl.
CPC ..... *F04D 29/64* (2013.01); *F04D 29/668* (2013.01); *F24F 1/38* (2013.01); *F24F 1/40* (2013.01);
(Continued)

(58) Field of Classification Search
CPC ..... F24F 1/38; F24F 1/40; F24F 2013/205; F24F 2221/16; F04D 29/64; F04D 29/668; F04D 17/16; F04D 29/601
See application file for complete search history.

(56) References Cited

U.S. PATENT DOCUMENTS 5,033,711 A 7/1991 Gregorich et al.
5,396,782 A * 3/1995 Ley ..... F24F 13/32 62/297
(Continued)

OTHER PUBLICATIONS

The VMC Group, "SAB Single Arm Brace", 2019, pp. 1-3, https://thevmcgroup.com/Catalog/SubCategoryProduct?subCatProdId=92.
(Continued)

*Primary Examiner* — Kun Kai Ma
(74) *Attorney, Agent, or Firm* — Fletcher Yoder, P.C.

(57) ABSTRACT

A blower mounting assembly of a heating, ventilation, and/or air conditioning (HVAC) system includes a bracket assembly including a base panel, a plurality of mounting flanges extending from the base panel, and an alignment flange extending from and transverse to the base panel. The blower mounting assembly includes a first mounting aperture extending through the base panel in a first direction and includes second mounting apertures extending through the plurality of mounting flanges in a second direction transverse to the first direction. The blower mounting assembly includes a bolt configured to extend through and slidably engage with an aperture of the alignment flange and a blower mounting skid such that the bolt limits movement of the blower mounting skid relative to the bracket assembly. The aperture of the alignment flange extends through the alignment flange in a third direction transverse to the first mounting aperture and the second mounting apertures.

25 Claims, 11 Drawing Sheets

(51) Int. Cl.
*F04D 29/66* (2006.01)
*F24F 1/40* (2011.01)
*F24F 13/20* (2006.01)

(52) U.S. Cl.
CPC ..... *F24F 2013/205* (2013.01); *F24F 2221/16* (2013.01)

(56) References Cited

U.S. PATENT DOCUMENTS 6,260,373 B1 * 7/2001 Rockwood ..... F16F 7/104
165/69
7,128,302 B2 * 10/2006 Dubensky ..... E04B 1/3483
248/638

OTHER PUBLICATIONS

Greenheck, "Centrifugal Inline Fans Models SQ and BSQ Direct and Belt Drive", 2013, pp. 1-48.

* cited by examiner

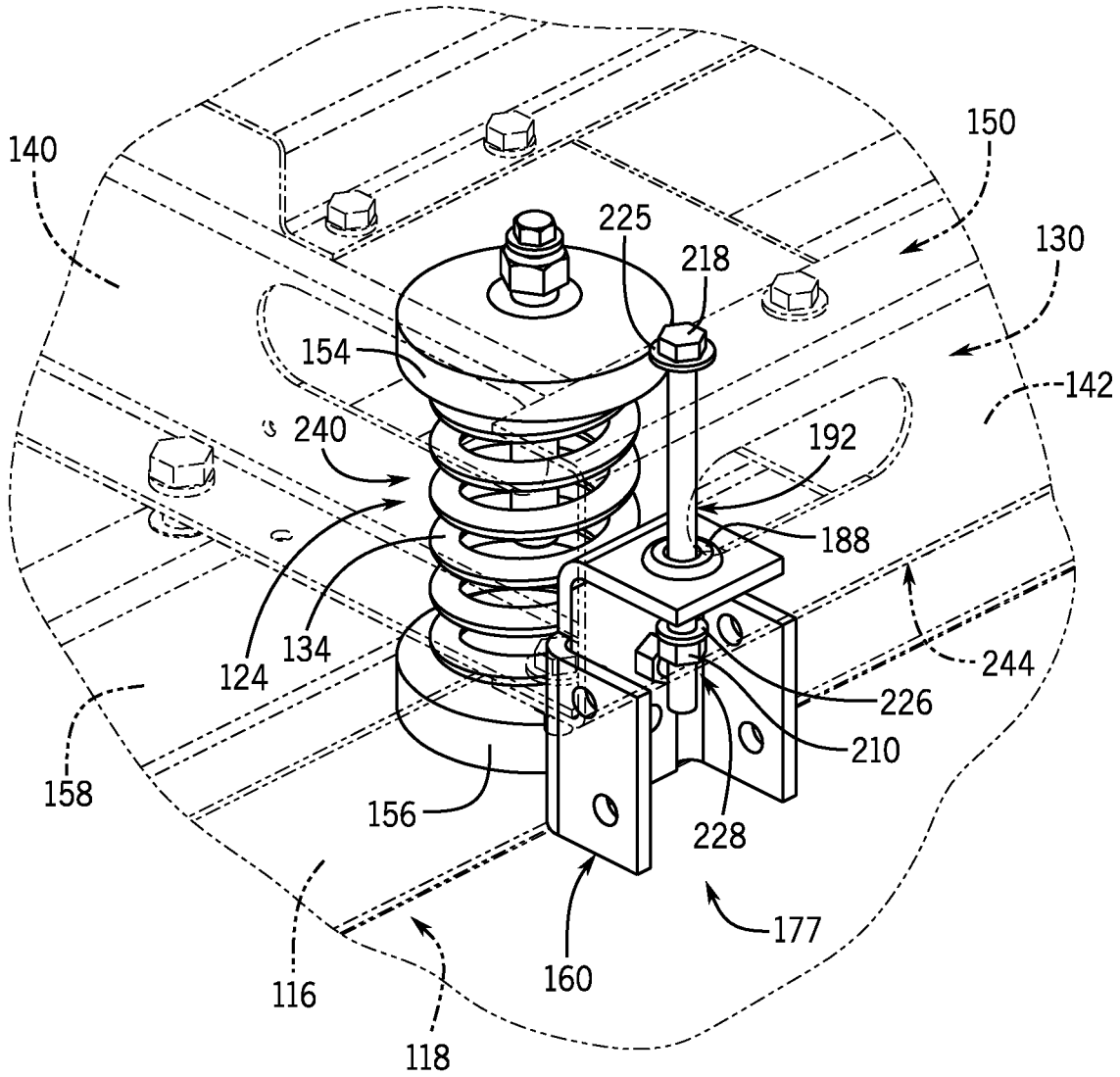
FIG. 9
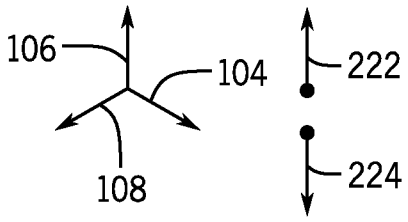

BRACKET ASSEMBLY FOR AN HVAC SYSTEM

CROSS-REFERENCE TO RELATED APPLICATIONS

This application claims priority from and the benefit of U.S. Provisional Application Ser. No. 62/898,944, entitled "BRACKET ASSEMBLY FOR AN HVAC SYSTEM," filed Sep. 11, 2019, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system may regulate such environmental properties through control of an air flow delivered to the environment by a blower or a fan. Indeed, the blower may be configured to direct air across a heat exchanger of the HVAC system to facilitate exchange of thermal energy between the air and a refrigerant flowing through tubes of the heat exchanger. As such, the blower may direct conditioned air discharging from the heat exchanger to rooms or spaces within a building or other suitable structure serviced by the HVAC system.

Typical blowers include a rotor that is positioned within a housing of the blower and is configured to rotate relative to the housing. For example, a motor may be used to drive rotation of the rotor, and thus, enable the rotor to force an air flow through the housing. In some cases, rotation of the rotor may generate vibrational forces that cause the blower to vibrate or oscillate during operation. Unfortunately, such vibrational forces may be transferred to other HVAC components positioned near the blower, which may cause these HVAC components to incur performance degradation over time.

SUMMARY

The present disclosure relates to a blower mounting assembly of a heating, ventilation, and/or air conditioning (HVAC) system. The blower mounting assembly includes a bracket assembly including a base panel, a plurality of mounting flanges extending from and transverse to the base panel, and an alignment flange extending from and transverse to the base panel. The alignment flange extends transverse to each of the plurality of mounting flanges. The blower mounting assembly includes a first mounting aperture extending through the base panel in a first direction. The blower mounting assembly also includes second mounting apertures extending through the plurality of mounting flanges in a second direction transverse to the first direction. The blower mounting assembly further includes a bolt configured to extend through and slidably engage with an aperture of the alignment flange and a blower mounting skid such that the bolt limits movement of the blower mounting skid relative to the bracket assembly. The aperture of the alignment flange extends through the alignment flange in a third direction transverse to the first mounting aperture and the second mounting apertures.

The present disclosure also relates to a mounting system for a blower of a heating, ventilation, and/or air conditioning (HVAC) unit. The mounting system includes a spring assembly configured to be disposed between a first rail of a blower mounting skid supporting the blower and a second rail of the HVAC unit. The mounting system also includes a bracket separate from the spring assembly. The bracket includes a mounting flange and an alignment flange, where the mounting flange is configured to mount to the second rail, and the alignment flange has an alignment aperture configured to receive a bolt engaged with the first rail. The alignment aperture is configured to restrict lateral movement of the bolt and enable axial movement of the bolt to enable limited movement of the blower mounting skid relative to the HVAC unit.

The present disclosure also relates to a bracket configured to mount a blower assembly in a heating, ventilation, and/or air conditioning (HVAC) system. The bracket includes a base panel having a first mounting aperture and a plurality of mounting flanges, where each mounting flange of the plurality of mounting flanges extends from the base panel and has a respective second mounting aperture that extends in a direction transverse to a direction in which the first mounting aperture extends. The bracket also includes an alignment flange extending from the base panel and having an alignment aperture configured to receive a bolt engaged with the blower assembly.

BRIEF DESCRIPTION OF THE DRAWINGS

FIG. 9 is a perspective view of an embodiment of a portion of a blower assembly, in accordance with an aspect of the present disclosure;

DETAILED DESCRIPTION

Figure 1:
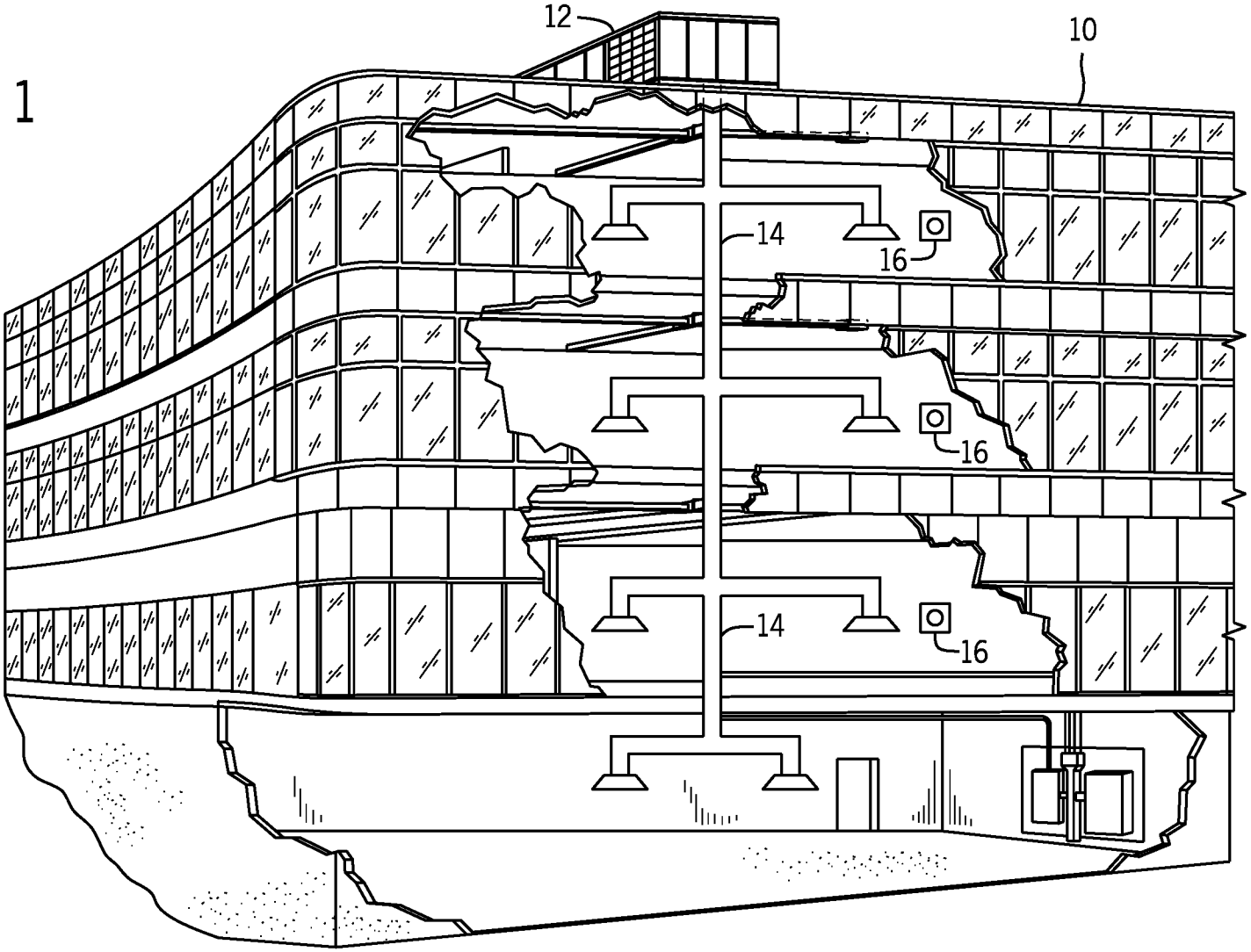
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. The HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via conduits to form a refrigerant circuit. A compressor of the refrigerant circuit may be used to circulate the refrigerant through the conduits and enable the transfer of thermal energy between the condenser and the evaporator.

The HVAC system generally includes a blower or a fan that is configured to direct an air flow across the condenser and/or the evaporator to facilitate heat exchange between the air flow and the refrigerant circulating through the condenser and the evaporator. Conventional blowers typically include a rotor that is positioned within a blower housing and is configured to rotate about an axis of the rotor. For example, a motor, such as an electric motor, a hydraulic motor, or other suitable actuator, may be used to drive rotation of the rotor relative to the blower housing. Rotation of the rotor enables the rotor to draw an air flow into an inlet of the blower housing and to force the air flow through an outlet of the blower housing toward, for example, the evaporator or the condenser.

As noted above, rotation of the rotor may generate vibrational forces that propagate from the blower during operation of the blower. For example, the generated vibrational forces may be transferred from the blower to a support frame configured to support the blower within an HVAC unit. Accordingly, the support frame may transfer the vibrational forces to other HVAC components coupled to the support frame or positioned near the support frame within the HVAC unit.

In some embodiments, one or more spring and/or damper assemblies may be positioned between the support frame and a frame of the HVAC unit to mitigate the transfer of such vibrational forces from the blower to other components of the HVAC unit. Indeed, the spring and/or damper assemblies may be configured to elastically extend and compress to absorb some or substantially all of the vibrational energy generated during operation of the blower. Unfortunately, the spring and/or damper assemblies enable the blower to oscillate in directions that may cause the blower to interfere with other HVAC components positioned within the HVAC unit and/or adjacent to the blower. Such interference between the blower and the HVAC components may generate unpleasant audible noise that propagates from the HVAC unit and, in some cases, may cause the blower or the HVAC components to incur performance degradation over time.

It is now recognized that enabling limited movement of the blower along a predetermined axis, while substantially blocking movement of the blower along other axes, may substantially eliminate a likelihood of interference between the blower and other HVAC components positioned adjacent the blower, while still enabling the spring and/or damper assemblies to mitigate the transfer of vibrational forces from the blower to the HVAC unit. That is, it is now recognized that limiting a range of motion the spring and/or damper assemblies may block interference between the vibrating or oscillating blower and the surrounding HVAC components, while still enabling the spring and/or damper assemblies to attenuate vibrational forces generated during operation of the blower.

Accordingly, embodiments of the present disclosure are directed to a bracket assembly that is configured to limit a range of movement provided by a spring and/or damper assembly supporting a blower within an HVAC unit of an HVAC system. As such, the bracket assembly and the spring and/or damper assembly may collectively form a mounting system for adjustably coupling the blower to the HVAC unit. In other words, the bracket assembly and the spring and/or damper assembly couple the blower to the HVAC unit while enabling limited movement of the blower relative to the HVAC unit. For example, the mounting system may include a blower mounting skid that is coupled to the blower and is configured to support the blower. One or more spring and/or damper assemblies may be positioned between the blower mounting skid and an HVAC frame of the HVAC unit, such that the spring and/or damper assemblies may suspend the blower mounting skid and the blower above the HVAC frame. The spring and/or damper assemblies may enable the blower mounting skid and the blower to collectively move or oscillate relative to the HVAC frame. The bracket assembly, or a plurality of bracket assemblies, may be fixedly coupled to the HVAC frame via suitable fasteners. The bracket assembly includes a bolt extending therethrough, which is configured to engage with the blower mounting skid positioned above the HVAC frame. The bolt is configured to enable limited movement of the blower mounting skid relative to the HVAC frame along a predetermined axis, such as a vertical axis, while substantial blocking movement of the blower mounting skid relative the HVAC frame along other axes, such as lateral and longitudinal axes. In this manner, the bracket assembly enables the spring and/or damper assemblies to expand and compress to attenuate vibrational forces that may be generated by the rotor during operation of the blower, while substantially blocking movement of the blower along certain non-permitted directions. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
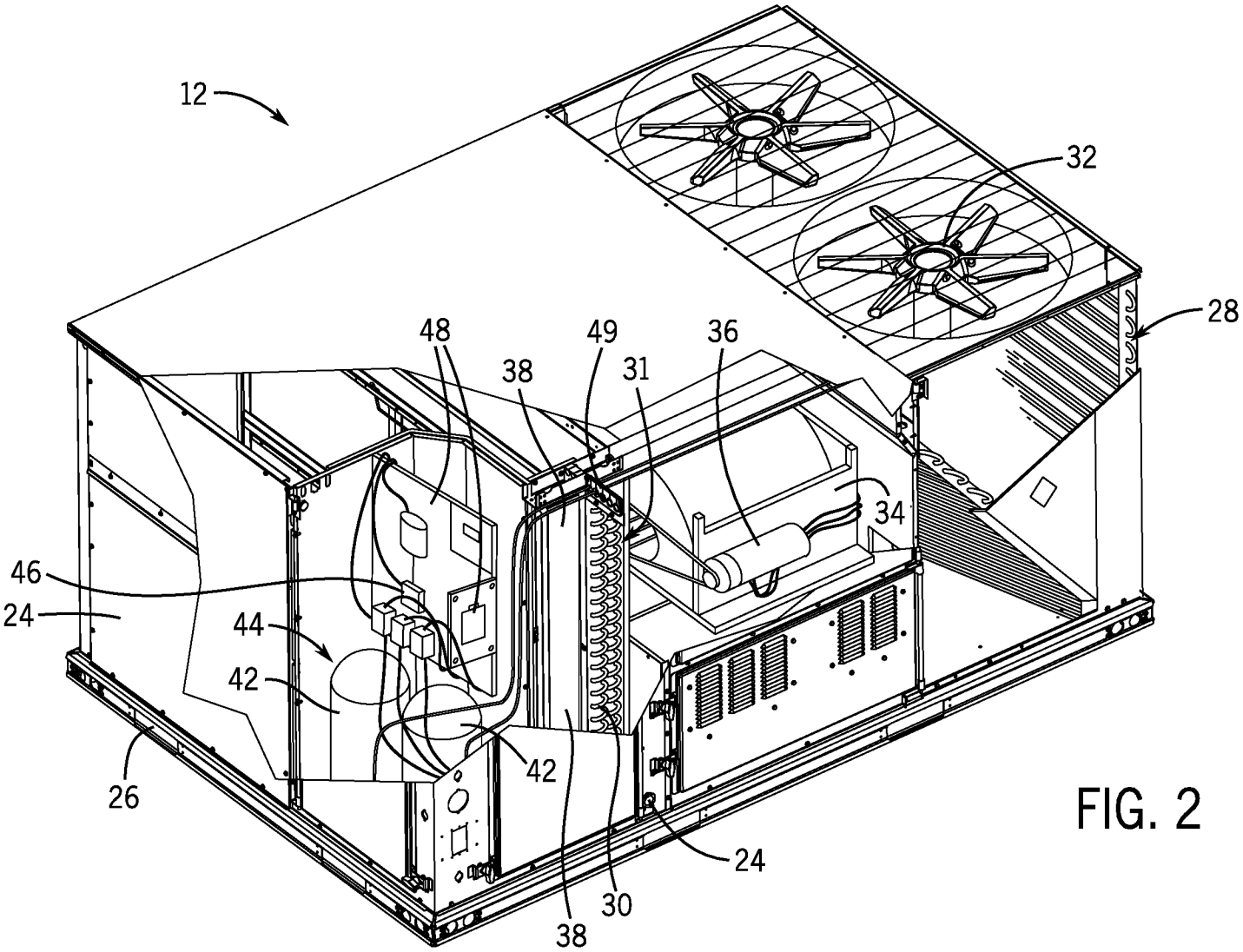
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
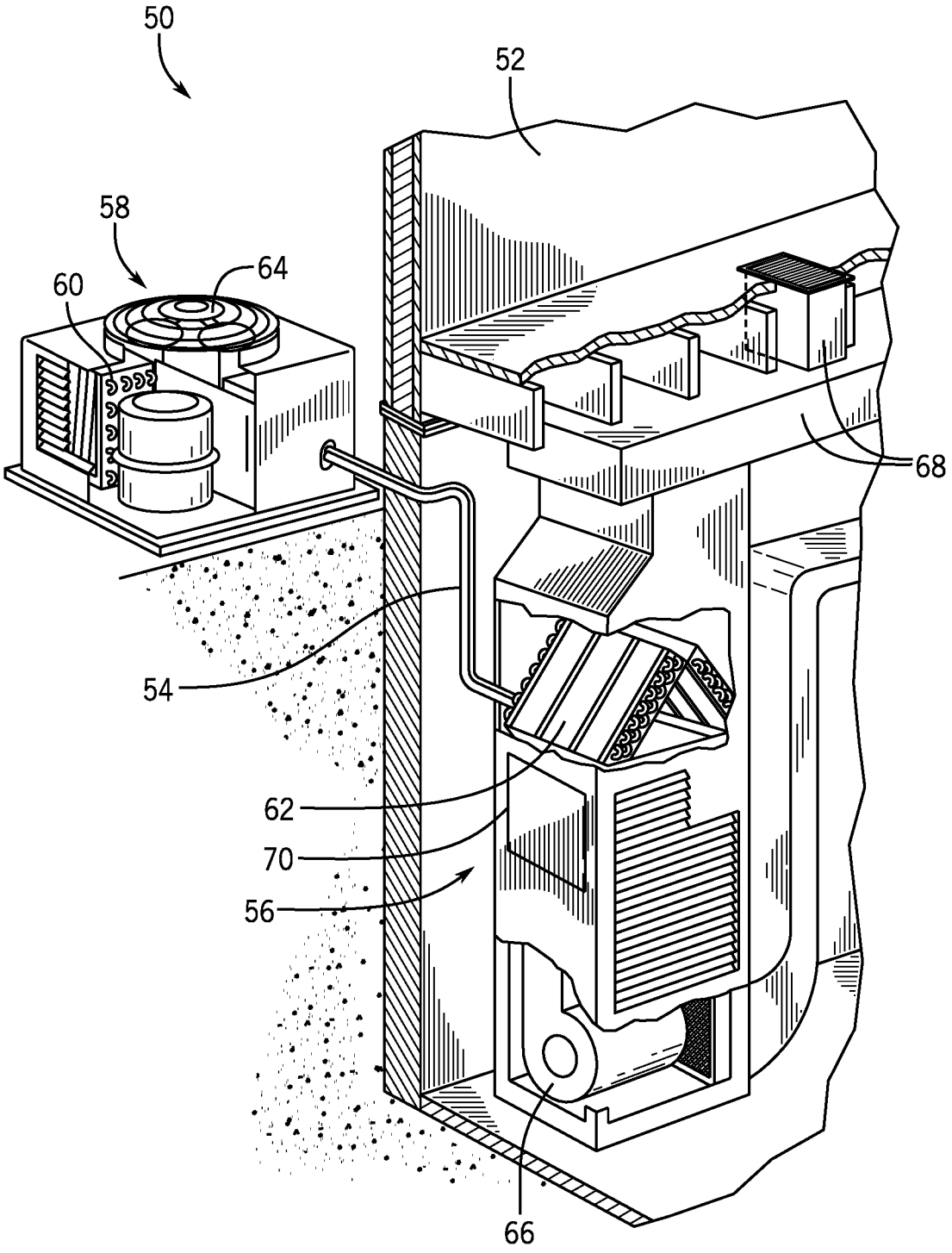
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
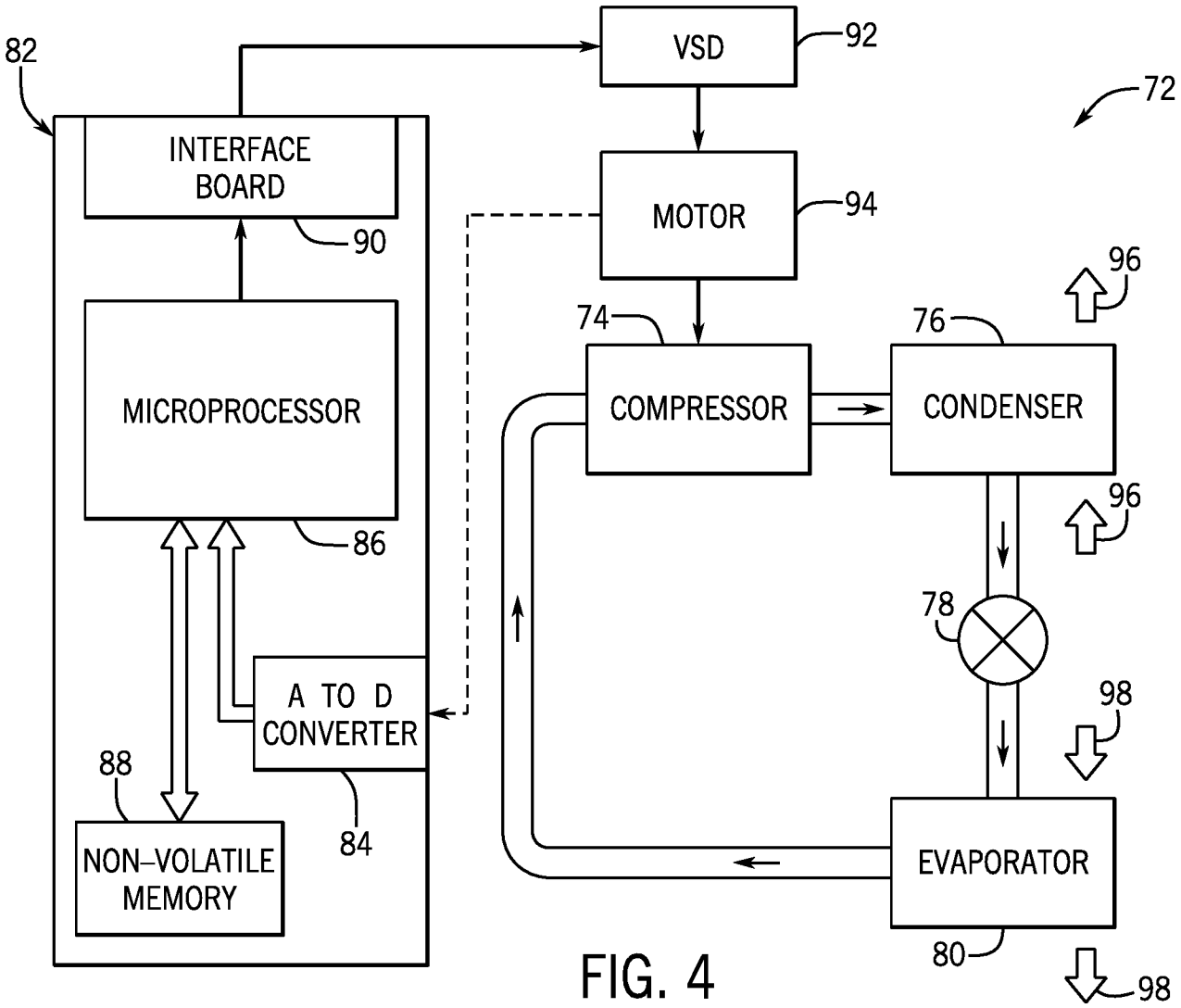
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems typically include one or more fans or blowers that may be used to direct an air flow across or through various components of the HVAC system. For clarity, as used herein, a "fan" or a "blower" may refer to any suitable flow generating device that is configured to force a fluid flow along a flow path via a plurality of fan blades, a rotor assembly, an impeller, or another suitable structure. Moreover, it should be noted that the terms "fan" and "blower" may be used interchangeably throughout the following discussion. As discussed above, in certain embodiments, the fans or blowers may be supported within an HVAC unit via one or more spring and/or damper assemblies. The spring assemblies may mitigate the transfer of vibrational forces from the blower to a frame or base of the HVAC unit supporting the blower. In some embodiments, the spring assemblies may enable the blower to oscillate in directions that cause the blower to interfere or otherwise engage with HVAC components positioned within the HVAC unit. Accordingly, embodiments of the present disclosure are directed toward a bracket assembly that is configured to control a range of movement enabled by the spring assemblies, such that the blower is substantially blocked from interference with other components of the HVAC unit.

Figure 5:
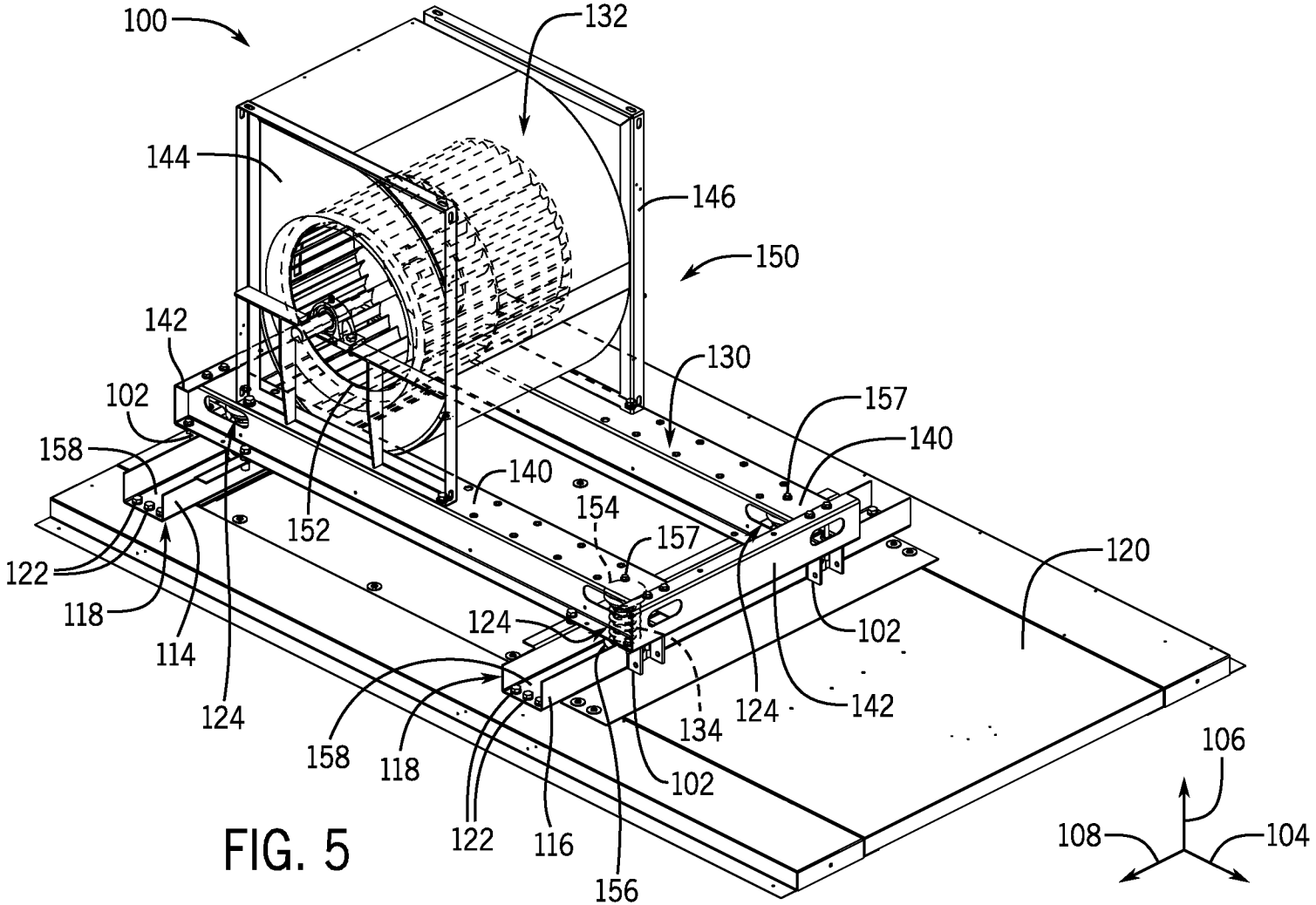
FIG. 5 is a perspective view of an embodiment of a blower assembly, in accordance with an aspect of the present disclosure.

With the foregoing in mind, FIG. 5 is a perspective view of an embodiment of a blower assembly 100 that includes a plurality of bracket assemblies 102. It should be noted that the blower assembly 100 and/or the bracket assemblies 102 may be included in embodiments or components of the HVAC unit 12 shown in FIG. 1, embodiments or components of the split, residential HVAC system 50 shown in FIG. 3, a rooftop unit (RTU), or any other suitable HVAC system. To facilitate discussion, the blower assembly 100, the bracket assemblies 102, and their respective components, will be described with reference to a longitudinal axis 104, a vertical axis 106, which is oriented relative to gravity, and a lateral axis 108.

In the illustrated embodiment, the blower assembly 100 includes a first frame rail 114 and a second frame rail 116 that collectively form a lower frame assembly 118 of the blower assembly 100. The lower frame assembly 118 may be coupled to a panel 120 of an HVAC unit, such as the HVAC unit 12, via suitable fasteners 122 including screws, friction pins, and/or rivets. In some embodiments, the panel 120 may include a floor or a lower surface of the HVAC unit. In other embodiments, the panel 120 may include any suitable surface or structure that is configured to support the blower assembly 100. Moreover, it should be understood that, in certain embodiments, the lower frame assembly 118 may be integrally formed with the panel 120.

The blower assembly 100 includes a plurality of spring assemblies 124 that are positioned between the lower frame assembly 118 and a blower mounting skid 130, which supports a blower 132. The spring assemblies 124 are configured to support a weight of the blower mounting skid 130 and a weight of components that may be positioned on the blower mounting skid 130, such as the blower 132. For example, each of the spring assemblies 124 may include a respective spring 134 that is configured to resist and/or damp movement of the blower mounting skid 130 toward the lower frame assembly 118. Accordingly, the springs 134 may collectively enable the spring assemblies 124 to suspend the blower mounting skid 130 above the lower frame assembly 118.

In some embodiments, the blower mounting skid 130 may be constructed of a pair of skid rails 140 and a pair of side rails 142 that are coupled to one another via suitable fasteners or via a metallurgical process, such as welding. In some embodiments, a housing 144 of the blower 132 may be rigidly coupled to the blower mounting skid 130 via an interface frame 146. Accordingly, the interface frame 146 may substantially block movement of the blower 132 relative to the blower mounting skid 130. However, it should be appreciated that, in other embodiments, polymeric isolators or dampers may be placed between the interface frame 146 and the blower mounting skid 130 to enable limited vibrational movement of the interface frame 146 relative to the blower mounting skid 130. In any case, the blower mounting skid 130, the interface frame 136, and the blower 132 may collectively form an upper frame assembly 150 of the blower assembly 100.

As noted above, operation of the blower 132 may cause certain components of the blower 132 to generate vibrational forces that may induce oscillation or vibration of the blower 132. For example, the blower 132 may include a rotor 152 that, when rotating relative to the housing 144, generates vibrational forces that propagate through the housing 144 and the interface frame 146. The interface frame 146 may transfer the vibrational forces from the housing 144 to the blower mounting skid 130, such that operation of the blower 132 may induce vibration of the upper frame assembly 150. The spring assemblies 124 are configured to enable movement of the blower mounting skid 130 relative to the lower frame assembly 118 to mitigate the transfer of such vibrational forces from the upper frame assembly 150 to the lower frame assembly 118. In particular, the springs 134 may elastically extend and compress to absorb vibrational energy that may be generated by the blower 132.

In some embodiments, the spring assemblies 124 may enable the upper frame assembly 150 to move or oscillate in directions that may cause a portion of the upper frame assembly 150 to engage with other HVAC components positioned adjacent to the blower assembly 100. Moreover, in certain embodiments, the spring assemblies 124 may not be fixedly coupled to the lower frame assembly 118 and/or to the blower mounting skid 130, such that vibrational forces generated during operation of the blower 132 and/or during transportation of the blower assembly 100 may cause the spring assemblies 124 to disengage from the lower frame assembly 118 and/or the blower mounting skid 130.

For example, in some embodiments, the spring assemblies 124 may each include a first end cap 154 that is coupled to a first end portion of a corresponding spring 134 and a second end cap 156 that is coupled to a second end portion of the corresponding spring 134. The first and second end caps 154, 156 may be formed from a metallic material that is coated in a polymer, such as rubber, or may be formed from any other suitable material. In certain embodiments, the first end caps 154 may be fixedly coupled to blower mounting skid 130 via respective fasteners 157, while the second end caps 156 are seated on the a surface 158 of the lower frame assembly 118 and are not fixedly coupled to the surface 158 via fasteners. Instead of coupling to the surface 158 via fasteners, the second end caps 156 may include respective protrusions extending therefrom, which are configured to engage with respective indentations or apertures formed within the surface 158 to position the second end caps 156 at particular locations along the lower frame assembly 118. Therefore, the vibrational forces generated during operation of blower 132 and/or during transportation of the blower assembly 100 may cause the protrusions of the second end caps 156 to become disengaged with their corresponding indentations or apertures within the surface 158, such that the spring assemblies 124 and the upper frame assembly 150 may translate across the surface 158 of the lower frame assembly 118 along the longitudinal or lateral axes 104, 108.

Accordingly, embodiments of the blower assembly 100 discussed herein are equipped with the bracket assemblies 102, which are configured to enable limited movement of the blower mounting skid 130 relative to the lower frame assembly 118 along a predetermined axis, such as the vertical axis 106, while substantially blocking movement of the blower mounting skid 130 along other axes, such as the longitudinal axis 104 and the lateral axis 108. In this manner, the bracket assemblies 102 may ensure that the upper frame assembly 150 is substantially blocked from moving along the longitudinal and lateral axes 104, 108 during operation of the blower assembly 100 and/or transportation of the blower assembly 100. However, it is important to note that, by enabling movement of the blower mounting skid 130 along the vertical axis 106, the bracket assemblies 102 still allow the spring assemblies 124 to effectively mitigate the transfer of vibrational forces between the upper frame assembly 150 and the lower frame assembly 118.

Figure 6:
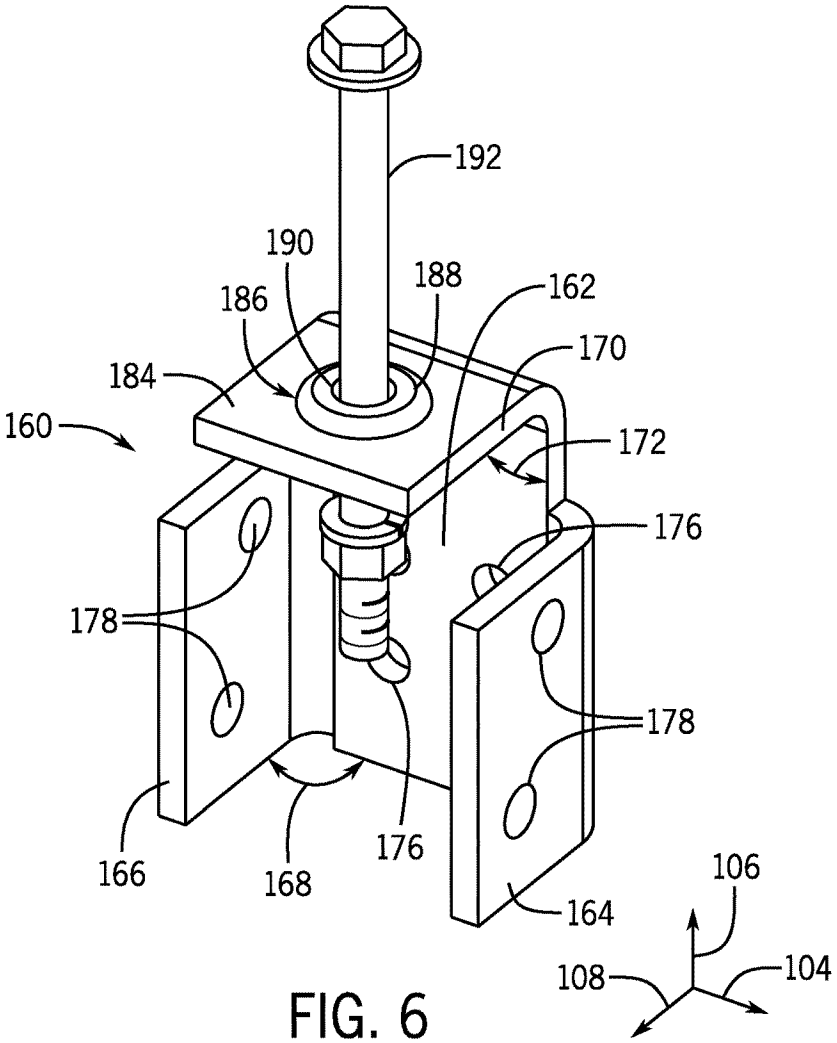
FIG. 6 is a perspective view of an embodiment of a bracket assembly for a blower assembly, in accordance with an aspect of the present disclosure.

To better illustrate one of the bracket assemblies 102 and to facilitate the following discussion, FIG. 6 is a perspective view of an embodiment of a bracket assembly 160. As shown in the illustrated embodiment, the bracket assembly 160 includes a base panel 162 with a first mounting flange 164 and a second mounting flange 166 extending therefrom. In some embodiments, the first and second mounting flanges 164, 166 may extend generally transverse to the base panel 162. That is, a respective angle 168 between the base panel 162 and each of the mounting flanges 164, 166 may be between about 80 degrees and about 100 degrees. In the illustrated embodiment, the bracket assembly 160 includes an alignment flange 170 that extends generally transverse from the base panel 162. Particularly, in some embodiments, an angle 172 between the base panel 162 and the alignment flange 170 may be between about 80 degrees and about 100 degrees. As such, the alignment flange 170 may extend generally transverse to the first mounting flange 164 and the second mounting flange 166.

Figure 8:
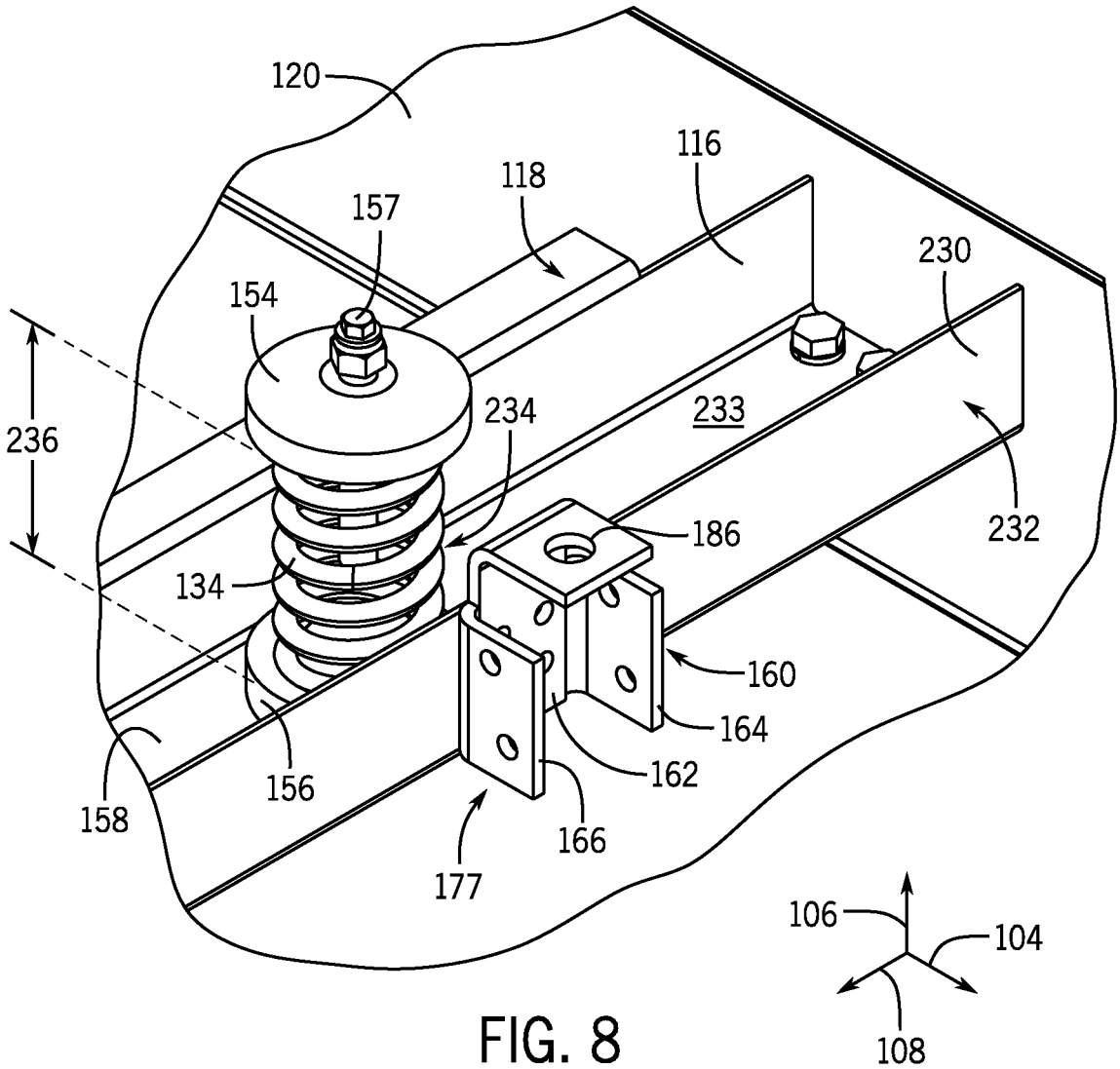
FIG. 8 is a perspective view of an embodiment of a portion of a blower assembly, in accordance with an aspect of the present disclosure.

As shown in the illustrated embodiment, the base panel 162 includes a plurality of first mounting apertures 176 formed therein, which may extend through the base panel 162 generally along the lateral axis 108. As discussed in detail below, the first mounting apertures 176 may be configured to align with corresponding apertures formed within the lower frame assembly 118, such that suitable fasteners may be used to couple the bracket assembly 160 to the lower frame assembly 118 in a first mounting configuration 177, as shown in FIG. 8. Particularly, in the first mounting configuration 177, the base panel 162 may be configured to abut a surface of the lower frame assembly 118. Accordingly, the base panel 162 may function as a mounting flange of the bracket assembly 160.

Figure 12:
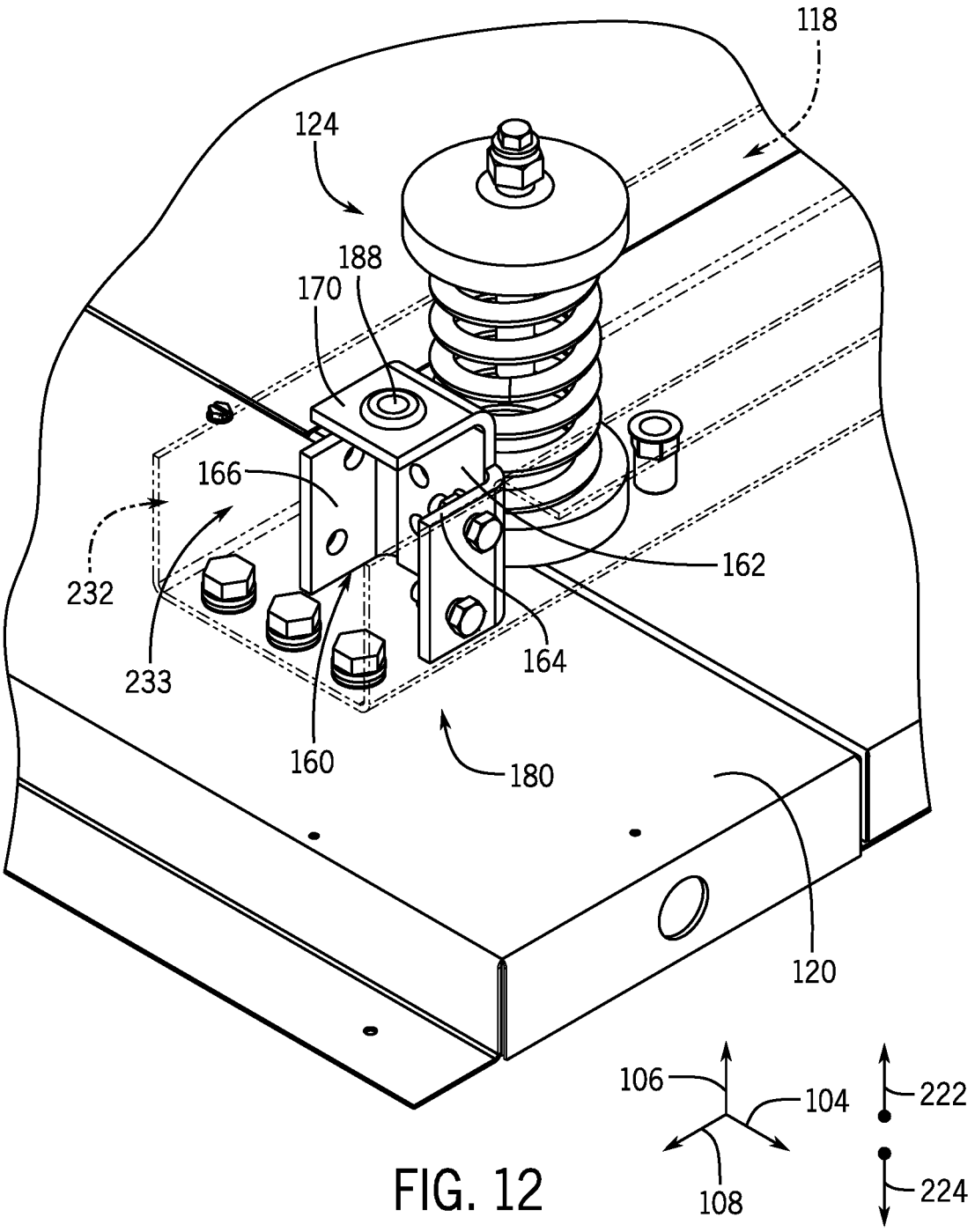
FIG. 12 is a perspective view of an embodiment of a portion of a blower assembly, in accordance with an aspect of the present disclosure.

The first mounting flange 164 and the second mounting flange 166 may each include a plurality of second mounting apertures 178 formed therein, which extend through the first and second mounting flanges 164, 166 generally along the longitudinal axis 104. Accordingly, suitable fasteners may be used to couple the bracket assembly 160 to the lower frame assembly 118 in a second mounting configuration 180, as shown in FIG. 12, in which the first mounting flange 164 is configured to abut a surface of the lower frame assembly 118. Alternatively, the second mounting apertures 178 may enable suitable fasteners to couple the second mounting flange 166 to a surface of the lower frame assembly 118, thereby enabling the bracket assembly 160 to couple to the lower frame assembly 118 in a third mounting configuration. Indeed, as discussed below, the first and second mounting apertures 176, 178 may enable the bracket assembly 160 to couple to the lower frame assembly 118 in multitudinous mounting orientations, such that the bracket assembly 160 may be implemented on various embodiments of the blower assembly 100.

In some embodiments, a body 184 of the bracket assembly 160 may be a single-piece component that is bent or deformed to form the base panel 162, the first mounting flange 164, the second mounting flange 166, and the alignment flange 170. For example, the body 184 may be formed from a single piece of metallic material, such as stamped steel. In other embodiments, the base panel 162, the first mounting flange 164, the second mounting flange 166, and/or the alignment flange 170 may include separate components that are coupled to one another, such as via a welding process, to form the body 184. Moreover, it should be understood that, in certain embodiments, the first mounting flange 164, the second mounting flange 166, or both, may be omitted from the body 184.

In the illustrated embodiment, the alignment flange 170 includes an aperture 186 formed therein, which extends through the alignment flange 170 generally along the vertical axis 106. A grommet 188 is positioned within the aperture 186 and is coupled to the alignment flange 170 via, for example, an interference fit. In some embodiments, the grommet 188 may be formed from a polymeric material, such as plastic or rubber. In any case, the grommet 188 may include an opening 190 formed therein that is configured to receive a bolt 192. In certain embodiments, an inner diameter of the opening 190 may be substantially equal to, or marginally greater than, an outer diameter of the bolt 192. Accordingly, the grommet 188 may enable the bolt 192 to translate through the opening 190 generally along the vertical axis 106, while movement of the bolt 192 along the longitudinal axis 104 and the lateral axis 108 is substantially blocked. As discussed in detail below, the bolt 192 may be configured to couple to or otherwise engage with the blower mounting skid 130, such that the bolt 192 may guide movement of the upper frame assembly 150 relative to the lower frame assembly 118 substantially along the vertical axis 106. It should be appreciated that, in some embodiments, the grommet 188 may be omitted from the bracket assembly 160. In such embodiments, an inner diameter of the aperture 186 may be substantially equal to the outer diameter of the bolt 192, such that the aperture 186 may guide movement of the bolt 192 along the vertical axis 106.

Figure 7:
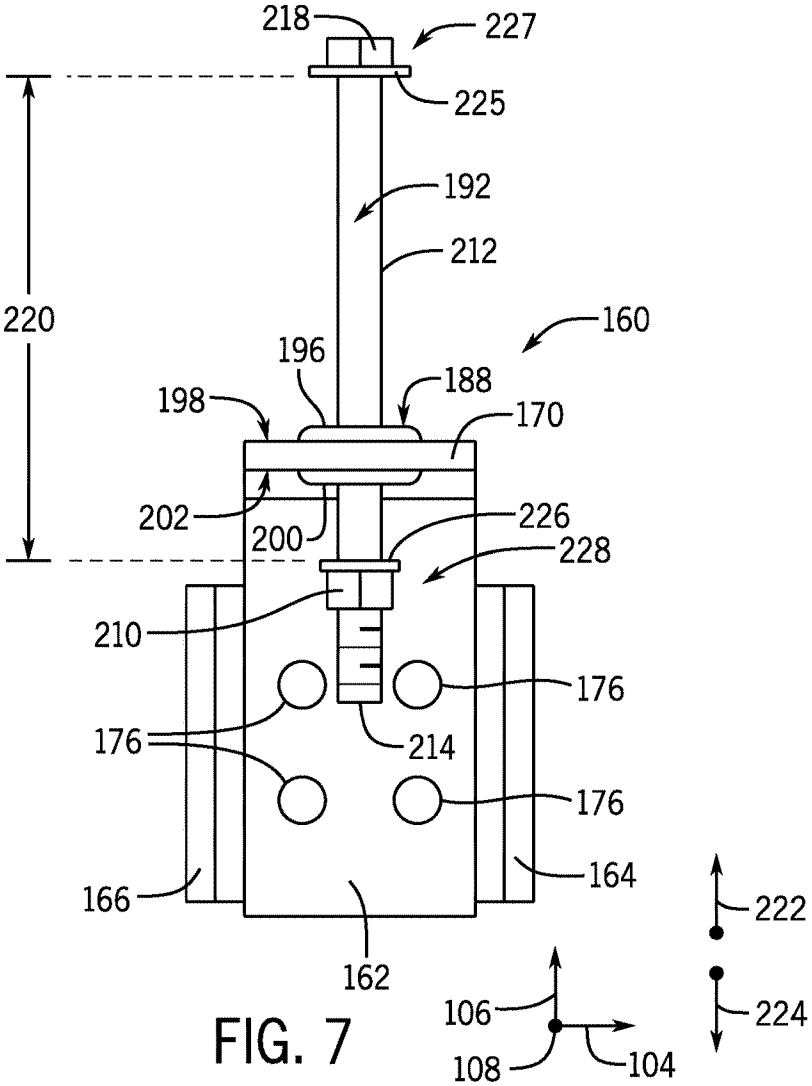
FIG. 7 is a front view of an embodiment of a bracket assembly for a blower assembly, in accordance with an aspect of the present disclosure.

FIG. 7 is a front view of an embodiment of the bracket assembly 160. As shown in the illustrated embodiment, the grommet 188 may include a first portion 196 that is configured to extend across a first surface 198 of the alignment flange 170 and a second portion 200 that is configured to extend across a second surface 202 of the alignment flange 170. Accordingly, the first and second portions 196, 200 of the grommet 188 may ensure that the grommet 188 does not become dislodged from the aperture 186 by, for example, sliding through the aperture 186 along the vertical axis 106. In the illustrate embodiment, a nut 210 is coupled to a shaft 212 of the bolt 192 via threads 214 formed on the shaft 212. The nut 210 may be spaced apart from a head 218 of the bolt 192 by a predetermined distance, referred to herein as a sliding length 220. The sliding length 220 defines a dimension by which the bolt 192 may translate along the vertical axis 106 in a first direction 222 or a second direction 224 before the head 218 or the nut 210, respectively, contact the first portion 196 or the second portion 200 of the grommet 188. As discussed below, the sliding length 220 may therefore define a range of motion by which the upper frame assembly 150 may oscillate relative to the lower frame assembly 118. In some embodiments, an upper washer 225 may be positioned adjacent the head 218, and a lower washer 226 may be positioned adjacent the nut 210. Accordingly, the head 218, the upper washer 225, or both, may form an upper head 227 of the bolt 192. The lower washer 226, the nut 210, or both, may form a lower head 228 of the bolt 192.

FIG. 8 is a perspective view of an embodiment of a portion of the lower frame assembly 118. In some embodiments, the first frame rail 114, the second frame rail 116, or both, may be formed as a channel. In the illustrated embodiment, the bracket assembly 160 is coupled to a flange 230 of the second frame rail 116 that forms a channel 232. Particularly, the bracket assembly 160 is coupled to the flange 230 in the first mounting configuration 177, in which the base panel 162 abuts an outer surface of the flange 230. As such, the bracket assembly 160 is positioned exterior to the channel 232. However, as discussed below, in other embodiments, the bracket assembly 160 may be coupled to the channel 232 such that the bracket assembly 160 is positioned within an interior 233 of the channel 232.

In the illustrated embodiment, the spring assembly 124 is in an uncompressed configuration 234, in which the spring 134 is extended at a resting length 236. For clarity, as used herein, the uncompressed configuration 234 of the spring assembly 124 is refers to a state of the spring assembly 124 in which no compressive forces or tensile forces are applied on the spring assembly 124. For example, the spring assembly 124 may be in the uncompressed configuration 234 when the upper frame assembly 150 is decoupled from the spring assembly 124.

Figure 10:
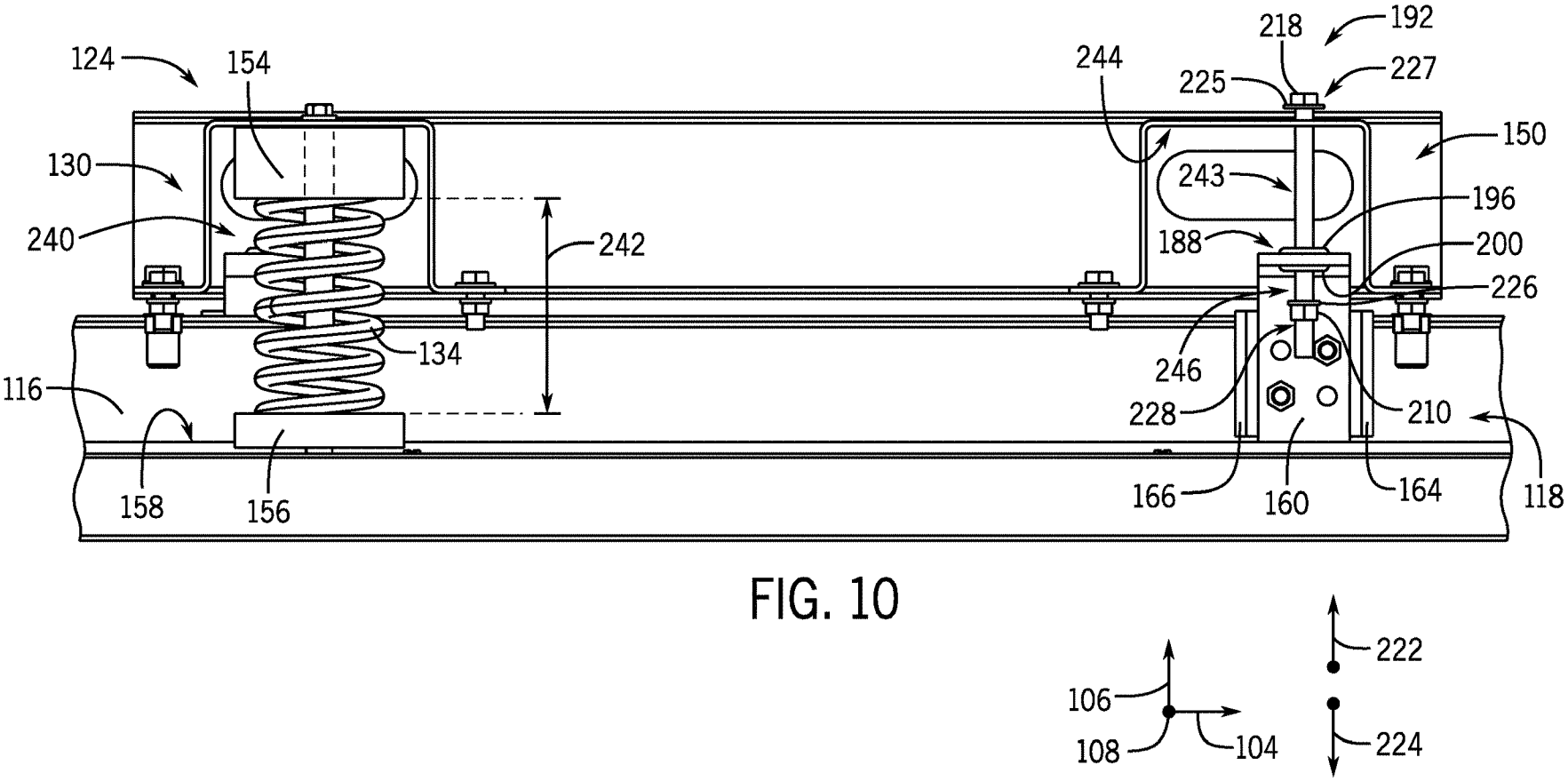
FIG. 10 is a side view of an embodiment of a portion of a blower assembly, in accordance with an aspect of the present disclosure.

FIG. 9 is a perspective view of an embodiment of a portion of the lower frame assembly 118 and a portion of the upper frame assembly 150. FIG. 10 is a side view of an embodiment of a portion of the lower frame assembly 118 and a portion of the upper frame assembly 150. FIGS. 9 and 10 will be discussed concurrently below. In the illustrated embodiments of FIGS. 9 and 10, the spring assembly 124 is in a compressed configuration 240 in which a compressive force is applied to the spring assembly 124 by a weight of the upper frame assembly 150 positioned on the spring assembly 124. In the compressed configuration 240 of the spring assembly 124, the spring 134 is compressed to a compressed length 242, which is less than the resting length 236 of the spring 134. That is, the compressed length 242 may be indicative of a length to which each of the springs 134 included in the blower assembly 100 compresses when the upper frame assembly 150 is positioned on the spring assemblies 124.

The bolt 192 may be engaged with the upper frame assembly 150 by extending through an aperture formed within the skid rail 140, through an aperture formed within the side rail 142, or through respective apertures formed within both the skid rail 140 and the side rail 142. In any case, the bolt 192 may thereby movably couple the upper frame assembly 150 to the bracket assembly 160. Accordingly, the bolt 192 enables limited movement of the upper frame assembly 150 relative to the lower frame assembly 118 along an axis of the aperture 186. That is, the bolt 192 may enable guided movement of the upper frame assembly 150 relative to the lower frame assembly 118 by enabling the upper frame assembly 150 to translate along a portion of the sliding length 220.

For example, when the spring assembly 124 is in the compressed configuration 240, a first gap 243 may extend between a lower surface 244 of the blower mounting skid 130 and the first portion 196 of the grommet 188, and a second gap 246 may extend between the lower head 228 of the bolt 192 and the second portion 200 of the grommet 188. Accordingly, the bracket assembly 160 enables the upper frame assembly 150 to translate in the first direction 222 along the vertical axis 106 by a dimension of the second gap 246 until the lower head 228 contacts the second portion 200 of the grommet 188, and enables the upper frame assembly 150 to translate in the second direction 224 along the vertical axis 106 by dimension of the first gap 243 until the lower surface 244 of the blower mounting skid 130 contacts the first portion 196 of the grommet 188. In this manner, the bracket assembly 160 enables the upper frame assembly 150 to oscillate along the vertical axis 106, relative to the lower frame assembly 118, by the dimension of the first gap 243 and the dimension of the second gap 246 during operation of the blower 132, such that the spring assembly 124 may attenuate vibrational energy that may be generated by operation of the blower 132. In some embodiments, the grommet 188 may dampen or substantially attenuate acoustic noise that may be generated when the lower surface 244 of the blower mounting skid 130 engages with the first portion 196 of the grommet 188 and/or when the lower head 228 engages with the second portion 200 of the grommet 188 during the oscillatory motion of the upper frame assembly 150 relative to the lower frame assembly 118.

It should be appreciated that a position of the nut 210 along the shaft 212 may be adjustable to increase or decrease a range of movement by which the upper frame assembly 150 may translate relative to the lower frame assembly 118. In some embodiments, the nut 210 may be positioned such that a length of the spring 134, when the lower head 228 contacts the second portion 200 of the grommet 188, is less than the resting length 236 of the spring 134. As such, the nut 210 may ensure that the spring 134 remains in a partially compressed state even when the upper frame assembly 150 is separated from the lower frame assembly 118 by a threshold distance permitted by the bolt 192. Accordingly, the nut 210 may ensure that second end cap 156 of the spring assembly 124 remains compressed against and engaged with the surface 158 of the lower frame assembly 118 throughout the permitted range of motion of the upper frame assembly 150.

It should be understood that, in some embodiments, the spring assemblies 124 collectively support substantially all of the weight of the upper frame assembly 150, such that substantially none of the weight of the upper frame assembly 150 is supported by the bracket assemblies 102. Indeed, the bracket assemblies 102 may guide movement of the upper frame assembly 150 relative to the lower frame assembly 118 without supporting the weight to the upper frame assembly 150.

Figure 11:
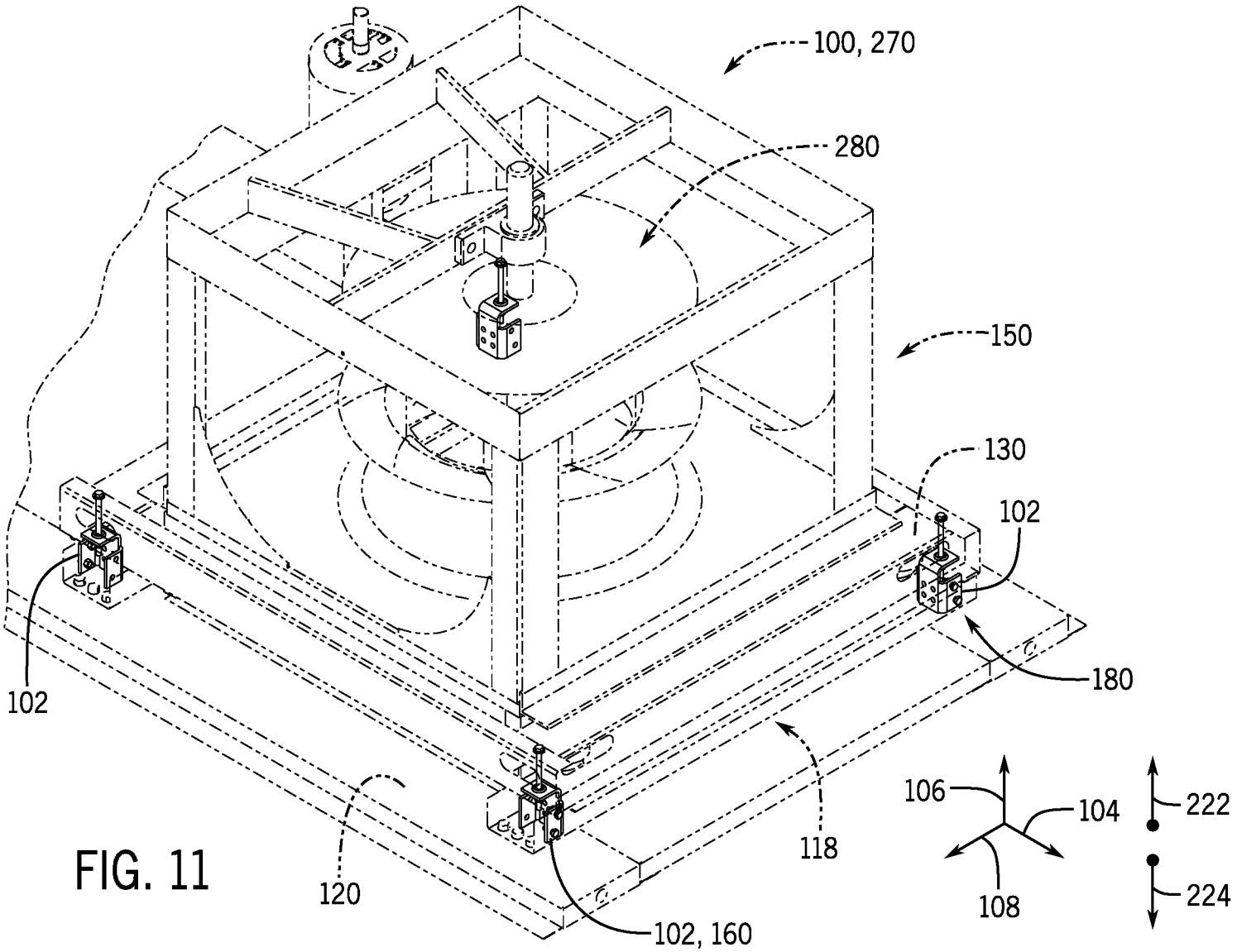
FIG. 11 is a perspective view of an embodiment of a blower assembly, in accordance with an aspect of the present disclosure.

FIG. 11 is a perspective view of another embodiment of the blower assembly 100. In particular, FIG. 11 illustrates a blower assembly 270 in which the bracket assemblies 102 are coupled to the lower frame assembly 118 in the second mounting configuration 180. FIG. 12 is a perspective view of an embodiment of a portion of the lower frame assembly 118 of the blower assembly 270. As noted above, in the second mounting configuration 180, the first mounting flange 164, instead of the base panel 162, may be coupled to frame rails 114, 116 of the lower frame assembly 118. As shown in the illustrated embodiment, in the second mounting configuration 180, the bracket assembly 160 may be positioned within the interior 233 of the channel 232, which may therefore reduce an overall exterior dimension of the blower assembly 270, as compared to an exterior dimension of the blower assembly 100.

It should be understood that the blower assembly 100 and the blower assembly 270 may include any suitable quantity of the bracket assemblies 102. For example, in some embodiments, the blower assemblies 100, 270 may each include 1, 2, 3, 4, or more than four bracket assemblies 102. Moreover, in certain embodiments, each of the spring assemblies 124 may be associated with a corresponding one of the bracket assemblies 102. It should be noted that the blower 132 of the blower assembly 100 and a blower 280 of the blower assembly 270 may each be a return air blower, an exhaust air blower, an outdoor air blower, or any other suitable blower, fan, or flow generating device that may be included in an HVAC system having the blower assemblies 100, 270.

As set forth above, embodiments of the present disclosure may provide one or more technical effects useful for defining a range of movement of the upper frame assembly 150 relative to the lower frame assembly 118 of the blower assembly 100. In particular, by enabling limited movement of the upper frame assembly 150 relative to the lower frame assembly 118 along the vertical axis 106, while substantially blocking movement of the upper frame assembly 150 relative to the lower frame assembly 118 along the longitudinal axis 104 and the lateral axis 108, the bracket assembly 160 may enable the spring assembly 124 to effectively attenuate vibrational energy that may be generated by operation of the blower 132 while blocking interference between the upper frame assembly 150 and HVAC components that may be positioned adjacent to the upper frame assembly 150. The restricted, guided movement of the upper frame assembly 150 relative to the lower frame assembly 118 may also maintain the position of the spring assemblies 124 between the upper frame assembly 150 and lower frame assembly 118. Moreover, the bracket assembly 160 may block movement of the upper frame assembly 150 in non-permitted directions during, for example, transportation of the blower assembly 100 on a mobile truck or during occurrence of certain natural events, such as earthquakes or other seismic events. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A blower mounting assembly of a heating, ventilation, and/or air conditioning (HVAC) system, comprising:

a bracket assembly including a base panel, a plurality of mounting flanges fixedly attached to extending from, and transverse to the base panel, and an alignment flange extending from and transverse to the base panel and extending transverse to each mounting flange of the plurality of mounting flanges;

a first mounting aperture extending through the base panel along a first axis;

second mounting apertures extending through the plurality of mounting flanges along a second axis transverse to the first axis; and a bolt configured to extend through and slidabley engage with an aperture of the alignment flange and a blower mounting skid such that the bolt limits movement of the blower mounting skid relative to the bracket assembly, wherein the aperture of the alignment flange extends through the alignment flange along a third axis transverse to the first axis and the second axis.

2. The blower mounting assembly of claim 1, comprising the blower mounting skid having a blower coupled thereto.

3. The blower mounting assembly of claim 2, comprising a spring assembly including a first end and a second end, the first end fixedly coupled to the blower mounting skid and the second end seated on a frame positioned adjacent the blower mounting skid, wherein the spring assembly is configured to resist movement of the blower mounting skid toward the frame.

4. The blower mounting assembly of claim 1, wherein the base panel is coupled to a frame via a fastener extending through the first mounting aperture such that the bolt limits movement of the blower mounting skid relative to the frame.

5. The blower mounting assembly of claim 1, wherein a mounting flange of the plurality of mounting flanges is coupled to a frame via fasteners extending through respective mounting apertures of the second mounting apertures such that the bolt limits movement of the blower mounting skid relative to the frame.

6. The blower mounting assembly of claim 1, wherein the bracket assembly is coupled to a frame of an HVAC unit to enable limited movement of the blower mounting skid relative to the frame along the third axis.

7. The blower mounting assembly of claim 6, wherein the bolt includes an upper head engaged with a first surface of the blower mounting skid and includes a lower head, wherein a shaft of the bolt extends between the upper head and the lower head, and wherein the shaft extends through a grommet positioned in the aperture of the alignment flange and coupled to the alignment flange.

8. The blower mounting assembly of claim 7, wherein the bolt is configured translate relative to the grommet and the alignment flange in a first direction until the lower head engages with the grommet and is configured to translate relative to the grommet and the alignment flange in a second direction, opposite the first direction, until a second surface of the blower mounting skid engages with the grommet, wherein the second surface is opposite the first surface of the blower mounting skid.

9. The blower mounting assembly of claim 1, wherein the base panel, the plurality of mounting flanges, and the alignment flange are formed from single piece of metallic material.

10. The blower mounting assembly of claim 1, wherein a first mounting flange of the plurality of mounting flanges is fixedly attached to a first side of the base panel, and a second mounting flange of the plurality of mounting flanges is fixedly attached to a second side of the base panel opposite the first side.

11. A mounting system for a blower of a heating, ventilation, and/or air conditioning (HVAC) unit, comprising:

a spring assembly configured to be disposed between a first rail of a blower mounting skid supporting the blower and a second rail of the HVAC unit; and a bracket separate from the spring assembly and having:

a base panel;

a mounting flange fixedly attached to, extending from, and extending transverse to the base panel, wherein the mounting flange is configured to mount to the second rail; and an alignment flange fixedly attached to the base panel, wherein the alignment flange has an alignment aperture configured to receive a bolt engaged with the first rail, wherein the alignment aperture is configured to restrict lateral movement of the bolt and enable axial movement of the bolt to enable limited movement of the blower mounting skid relative to the HVAC unit.

12. The mounting system of claim 11, wherein the spring assembly is configured to support a weight of the blower mounting skid and the blower, and the bracket is not configured to support the weight.

13. The mounting system of claim 11, wherein the second rail is a channel, and wherein the bracket is configured to mount external to the channel in a first configuration and is configured to mount internal to the channel in a second configuration.

14. The mounting system of claim 11, wherein the spring assembly includes a first end fixedly coupled to the first rail via a fastener and includes a second end positioned on a surface of the second rail, wherein the second end is not fixedly coupled to the second rail.

15. The mounting system of claim 11, wherein the mounting flange extends generally transverse to the alignment flange.

16. The mounting system of claim 11, comprising a grommet positioned within the alignment aperture and disposed about a shaft of the bolt, wherein the grommet is made of a polymeric material and is configured to guide movement of the shaft through the alignment aperture.

17. The mounting system of claim 11, wherein the mounting flange is a first mounting flange, the bracket comprises a second mounting flange, the first mounting flange is fixedly attached to a first side of the base panel, and the second mounting flange is fixedly attached to a second side of the base panel opposite the first side.

18. A bracket configured to mount a blower assembly in a heating, ventilation, and/or air conditioning (HVAC) system, comprising:

a base panel having a first mounting aperture, wherein the first mounting aperture extends along a first axis;

an alignment flange extending from the base panel and having an alignment aperture configured to receive a bolt engaged with the blower assembly; and a plurality of mounting flanges extending from and transverse to the base panel, wherein the plurality of mounting flanges comprises:

a first mounting flange extending from a first side of the base panel; and a second mounting flange extending from a second side of the base panel opposite the first side, wherein each mounting flange of the plurality of mounting flanges has a respective second mounting aperture that extends along a second axis transverse to the first axis along which the first mounting aperture extends.

19. The bracket of claim 18, wherein the alignment flange includes a grommet extending through the alignment aperture, and wherein the grommet extends along a first surface of the alignment flange and along a second surface of the alignment flange opposite the first surface.

20. The bracket of claim 19, wherein the grommet is formed from a polymeric material and is configured to restrict lateral movement of the bolt within the alignment aperture relative to the first axis of the alignment aperture.

21. The bracket of claim 18, comprising the bolt and a nut coupled to the bolt to enable limited movement of the bolt through the alignment aperture.

22. The bracket of claim 18, wherein each mounting flange of the plurality of mounting flanges extends generally perpendicularly to the base panel.

23. The bracket of claim 22, wherein the alignment flange extends generally perpendicularly to the plurality of mounting flanges and the base panel.

24. The bracket of claim 18, wherein the first mounting aperture and the second mounting apertures are configured to enable securement of the bracket to a frame rail of the HVAC system in a plurality of orientations.

25. The bracket of claim 18, wherein the alignment flange and the plurality of mounting flanges are fixedly attached to the base panel.

* * * * *